US011939110B2

(12) United States Patent
Sommer

(10) Patent No.: US 11,939,110 B2
(45) Date of Patent: Mar. 26, 2024

(54) CONTAINER LID WITH NEST SEGMENT

(71) Applicant: Monoflo International, Inc., Winchester, VA (US)

(72) Inventor: Axel Sommer, Tacoma, WA (US)

(73) Assignee: MONOFLO INTERNATIONAL, INC., Winchester, VA (US)

( * ) Notice: Subject to any disclaimer, the term of this patent is extended or adjusted under 35 U.S.C. 154(b) by 4 days.

(21) Appl. No.: 17/326,657

(22) Filed: May 21, 2021

(65) Prior Publication Data

US 2022/0371776 A1 Nov. 24, 2022

(51) Int. Cl.
*B65D 21/02* (2006.01)

(52) U.S. Cl.
CPC ..... *B65D 21/0219* (2013.01); *B65D 21/0233* (2013.01)

(58) Field of Classification Search
CPC ..... B65D 21/0219; B65D 21/0222; B65D 2543/00768; B65D 2543/00694
USPC ..... 220/781
See application file for complete search history.

(56) References Cited

U.S. PATENT DOCUMENTS 4,286,713 A * 9/1981 Marchais ..... B65D 43/022 206/508
4,366,915 A * 1/1983 Seidler ..... A45C 11/24 220/837
4,499,997 A * 2/1985 Swingley, Jr. ..... B65D 81/261 206/427
4,523,692 A * 6/1985 Lemkin ..... B65D 55/14 206/508
4,703,857 A * 11/1987 Jahnen ..... B65D 43/0212 206/520
5,012,928 A 5/1991 Proffitt et al.
5,042,674 A * 8/1991 Ramsay ..... B65D 21/0219 206/508
D320,559 S * 10/1991 Olson ..... D9/454
5,419,451 A * 5/1995 Bitel, Jr. ..... B65D 43/0212 206/508
5,662,223 A * 9/1997 Sylegård ..... B65D 43/0222 206/508
5,673,791 A 10/1997 Jamison
5,692,633 A 12/1997 Gordon
5,988,420 A 11/1999 Jacques et al.
6,241,114 B1 * 6/2001 Savino ..... B65D 43/0212 206/508
6,364,096 B1 * 4/2002 De Baets ..... B65D 25/06 206/508
7,044,326 B2 5/2006 Martin et al.
9,049,949 B1 6/2015 Taylor
9,078,535 B1 7/2015 Buck
9,609,959 B1 4/2017 Taylor
10,501,299 B2 12/2019 Valentine
10,653,276 B2 5/2020 Krueger
(Continued)

*Primary Examiner* — Ernesto A Grano
*Assistant Examiner* — Symren K Sanghera
(74) *Attorney, Agent, or Firm* — NIXON & VANDERHYE P.C.

(57) ABSTRACT

A stackable container lid includes a top surface defining a flat surface plane without an upward protrusion, at least one recess in the top surface, a bottom surface including a rib structure adjacent a perimeter, and at least one nest segment integrated with the rib structure and protruding from the rib structure. The container lid is readily stackable with other container lids and is suited for handling with automation equipment.

18 Claims, 5 Drawing Sheets

(56) References Cited

U.S. PATENT DOCUMENTS

| | | | | |
|---|---|---|---|---|
| 10,820,756 | B2 | 11/2020 | Krueger | |
| 10,899,499 | B2 * | 1/2021 | Reinhart | B65D 21/04 |
| 10,968,029 | B1 | 4/2021 | Rane et al. | |
| 11,008,141 | B2 | 5/2021 | Savenok | |
| 11,072,469 | B1 | 7/2021 | Rane et al. | |
| 2003/0168465 | A1 * | 9/2003 | Breimon | B65D 21/022 220/781 |
| 2009/0179039 | A1 * | 7/2009 | Cimmerer | B65D 21/022 220/781 |
| 2010/0108556 | A1 * | 5/2010 | Claffy | B65D 25/04 206/508 |
| 2011/0278290 | A1 * | 11/2011 | Higginson | B65D 43/0212 29/428 |
| 2012/0031921 | A1 * | 2/2012 | Cadiente | B65D 43/162 220/788 |
| 2014/0034548 | A1 * | 2/2014 | Pylant | H01L 21/67369 206/710 |
| 2015/0027921 | A1 * | 1/2015 | Moon | B65D 51/245 206/524.8 |
| 2017/0107015 | A1 * | 4/2017 | Reinhart | B65D 43/0214 |
| 2017/0275058 | A1 * | 9/2017 | Bischoff | B65D 43/021 |
| 2018/0273254 | A1 * | 9/2018 | Hansen | B65D 43/0235 |
| 2019/0092524 | A1 * | 3/2019 | Reinhart | B65D 43/0204 |
| 2019/0119011 | A1 * | 4/2019 | Naomi | B65D 53/02 |
| 2019/0291927 | A1 * | 9/2019 | Farach | B65D 43/162 |
| 2020/0189806 | A1 * | 6/2020 | Sill | B65D 5/305 |
| 2020/0377267 | A1 * | 12/2020 | Lee | B65D 43/0212 |
| 2021/0053728 | A1 * | 2/2021 | Wang | B65D 51/242 |
| 2021/0139186 | A1 * | 5/2021 | Kobayashi | B65D 5/001 |
| 2021/0387775 | A1 * | 12/2021 | Haon | B65D 21/0219 |

* cited by examiner

CONTAINER LID WITH NEST SEGMENT

CROSS-REFERENCES TO RELATED APPLICATIONS (Not Applicable)

STATEMENT REGARDING FEDERALLY SPONSORED RESEARCH OR DEVELOPMENT (Not Applicable)

BACKGROUND

The invention relates to a container lid and container assembly and, more particularly, to a container lid suitable for handling by automation equipment.

In several new generation and fully automated warehouse systems, it is important that all components can be handled by automation equipment or robots and are compatible to be used in mixed stacks on distribution pallets with other unit loads like corrugated boxes and packages of bottles, jars, cans or the like. The plastic container with detached lid becomes a part of a logistic/distribution system. Existing plastic containers with lids have been mostly used in systems in which these had to be compatible only with themselves and no other unit loads.

Existing lids include a wraparound outer perimeter skirt which, in conjunction with upward protrusions, make the container lid nestable with other container lids. These aspects, however, inhibit handling by automation equipment.

SUMMARY

The container lid of the described embodiments is provided without protrusions facing upwards from the top level of the lid, enabling other unit loads to be stacked on a flat plane. The lid may include recessed areas since these are not interfering with the unit load stack on top of the lid.

The overall dimensions of the lid generally corresponds to the outer dimensions of the plastic container, which is typically a straight (fixed) wall container, a foldable or collapsible container or a nestable container. All plastic container types generally provide a rectangular top frame onto which the lid will be placed.

The lid is desirably nestable on other lids and can be securely stacked. Stacks of lids are typically transported on conveying systems or are stacked on pallets and transported by trucks and floor handling equipment. The nest feature prevents the lids from sliding off the stack.

The lids may include one or more snap segments that are engageable into a recess of the inner wall of the plastic container rim. Additionally, the lids may be provided with one or more engagement tabs that prevent the lid from deflecting downward/inward under the load of stacked packages.

In an exemplary embodiment, a stackable container lid includes a top surface defining a flat surface plane without an upward protrusion, at least one recess in the top surface, a bottom surface including a rib structure adjacent a perimeter, and at least one nest segment integrated with the rib structure and protruding from the rib structure.

The lid may further include an engagement tab or four engagement tabs on the bottom surface. The lid may include a snap segment or four snap segments on the rib structure. The snap segment(s) are positioned adjacent a corner of the rib structure. In some embodiments, the rib structure on which the snap segment(s) are disposed is thinner than a remainder of the rib structure.

The rib structure may include corner sections at each corner thereof and support sections connected between the corner sections, where the corner sections are positioned closer to the perimeter of the bottom surface than the support sections.

The lid may include a plurality of nest segments including one or two nest segments per each side of the container lid.

In some embodiments, a thickness of the container lid at the perimeter is consistent with a majority of non-perimeter portions of the container lid. In this context, the thickness of the container lid at the perimeter is consistent with the non-perimeter portions of the container lid except for the at least one recess. The container lid may be without an outer perimeter skirt.

In another exemplary embodiment, a container assembly includes a container body including an upper perimeter and the container lid of the described embodiments securable on the container body.

The container body may include a plurality of engagement tab pockets in the upper perimeter, where the engagement tabs on the bottom surface of the lid adjacent the perimeter engage the engagement tab pockets when the container lid is secured on the container body. The container body may include a plurality of snap segment recesses in an inner wall of the upper perimeter, where the snap segments on the rib structure of the lid engage the snap segment recesses when the container lid is secured on the container body.

BRIEF DESCRIPTION OF THE DRAWINGS

These and other aspects and advantages will be described in detail with reference to the accompanying drawings, in which.

DETAILED DESCRIPTION

Figure 1:
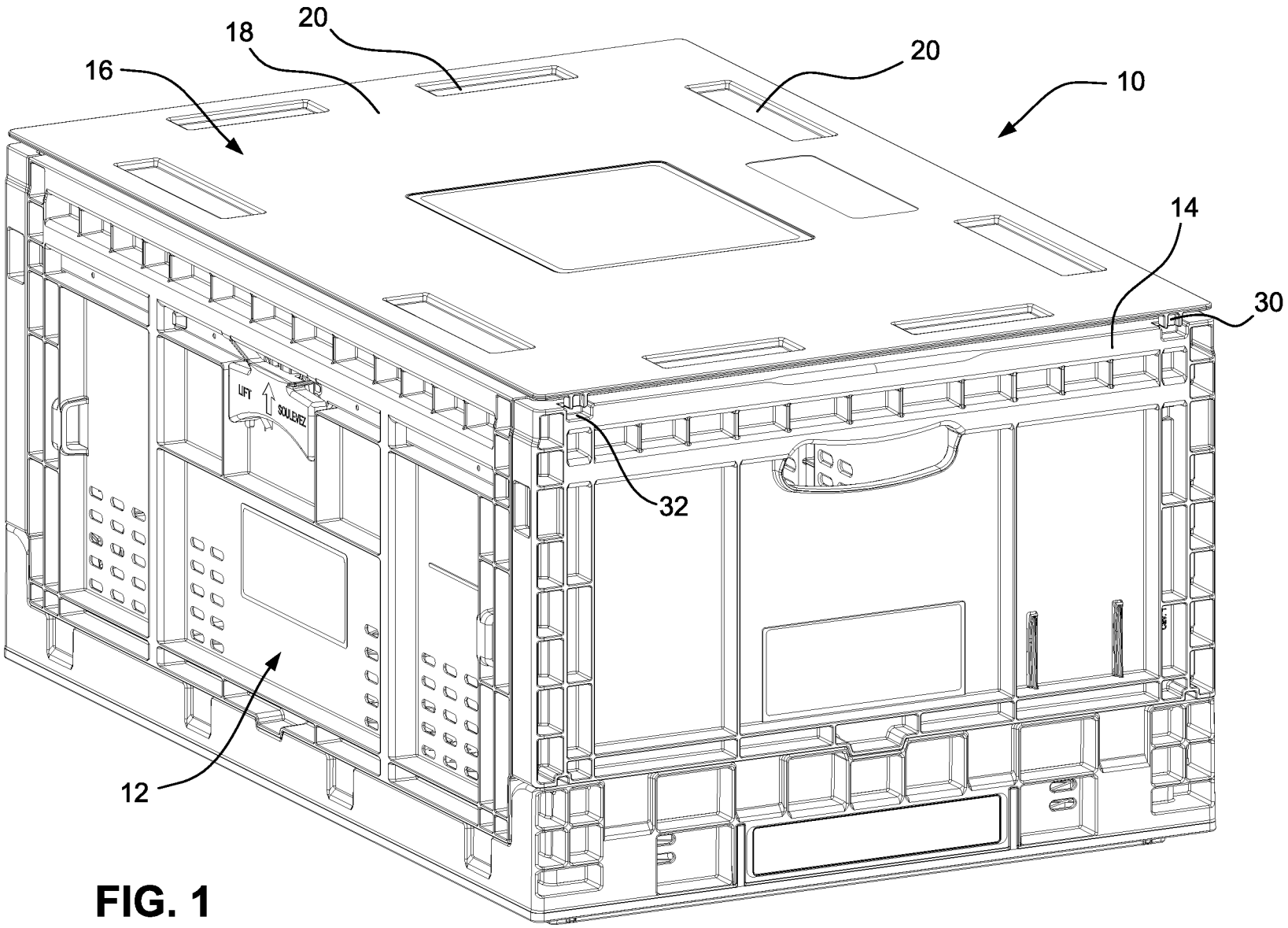
FIG. 1 is a perspective view of a container system including the stackable container lid of the described embodiments.
Figure 2:
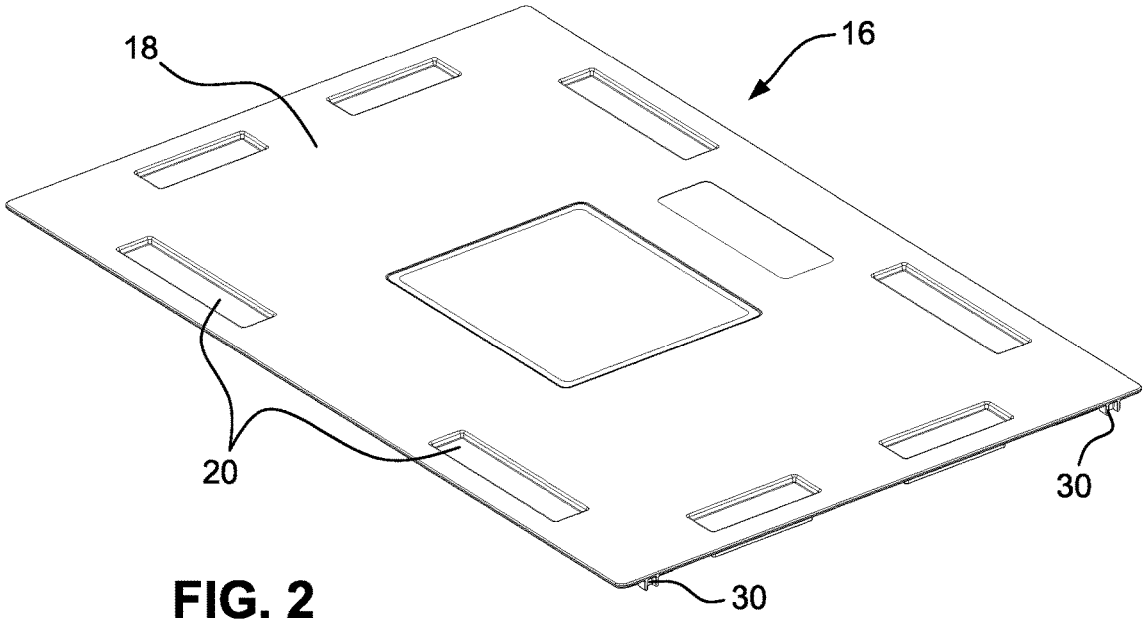
FIG. 2 is a top perspective view of the container lid.

FIG. 1 shows a container assembly 10 including a container body 12 with an upper perimeter 14 and a container lid 16 securable on the container body 12. With reference to FIGS. 1 and 2, the container lid 16 includes a top surface 18 that defines a flat surface plane without an upward protrusion. The top surface 18 includes at least one recess 20. In some embodiments, as shown in FIGS. 1 and 2, the container lid 16 may include two recesses 20 along each side. The lid 16 may alternatively include one recess 20 per side, or a single continuous recess may be provided adjacent the perimeter.

Figure 3:
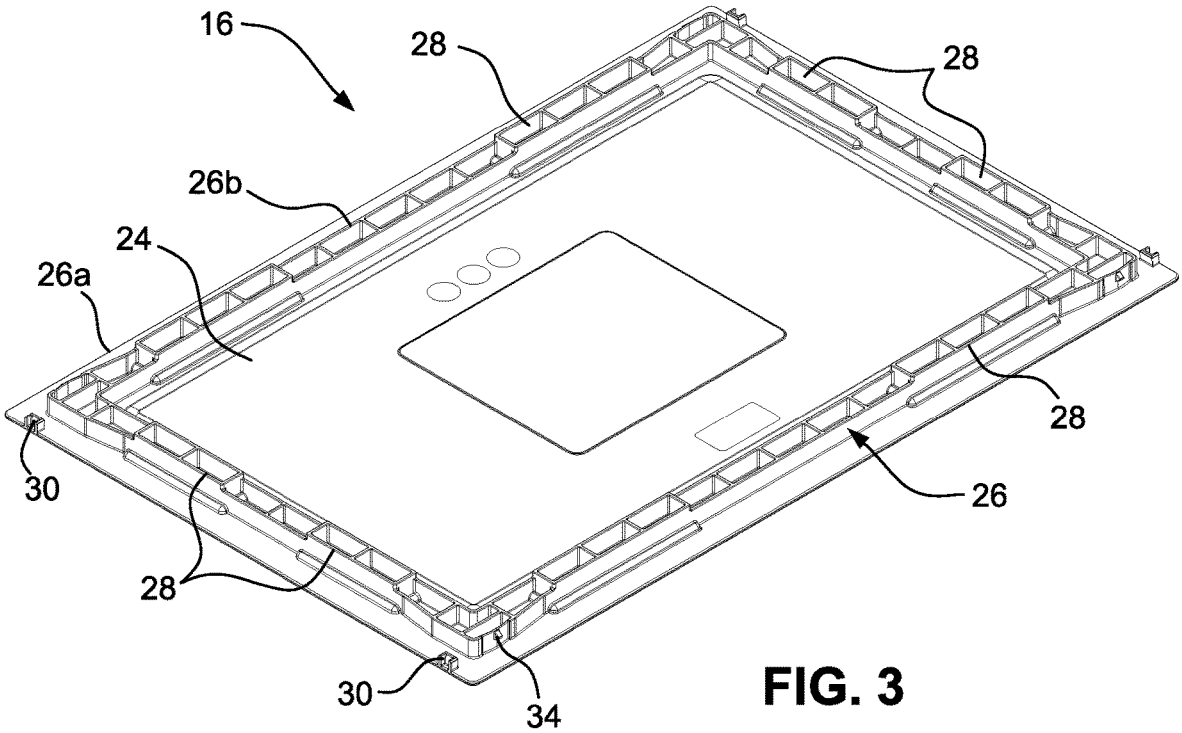
FIG. 3 is a bottom perspective view of the container lid.

As shown in FIG. 3, a bottom surface 24 of the container lid 16 includes a rib structure 26 adjacent the perimeter. At least one nest segment 28 is integrated with the rib structure 26 and protrudes from the rib structure 26. The nest segments 28 generally correspond to the recesses 20 on the top surface 18. The recess 20 in the top surface is made slightly larger than the nest segments to provide for adequate play in the nesting components. Like the recesses 20, the rib structure 26 may include, for example, two nest segments 28 per side. Alternatively, the rib structure 26 may include one nest segment 28 per side or the entirety of the rib structure 26 may define a single continuous nest segment. Using a single continuous recess and the entire rib structure as the nest segment is not desirable, however, as the structure would weaken the torsional stability of the lid and reduce the surface area of the top surface.

In some embodiments, the outside dimensions of the container lid 16 do not exceed the outer dimensions of the container body 12 to which the container lid is affixed. As shown, the container lid 16 of the described embodiments eliminates the conventional outer perimeter skirt along with the upward protrusions that have typically been used to facilitate nesting. That is, a thickness T (i.e., height) (FIG. 6) of the container lid at the perimeter is consistent with a majority of the non-perimeter portions of the container lid, except for the recess 20. The container lid 16 thus sits flat on the upper perimeter 14 of the container body 12.

The rib structure 26 provides torsional stability to the container lid 16. An outer surface of the rib structure 26, or at least portions of it, are dimensioned to register the lid 16 accurately on the plastic container body 12 to limit the amount of play between the lid and the container. With continued reference to FIG. 3, the rib structure 26 may include corner sections 26*a* at each corner thereof and support sections 26*b* connected between the corner sections 26*a*. As shown, the corner sections 26*a* are positioned closer to the perimeter than the support sections 26*b*. In this manner, the rib structure registers with the container body 12 in the corners. That is, because the corner sections 26*a* are positioned closer to the perimeter of the bottom surface than the support sections 26*b*, only the corner sections 26*a* register with the upper perimeter of the container body 12. The support sections 26*b* as shown are recessed to avoid possible interference with container walls in the event of any inward warp. An interference could cause an interruption of the fully automated lid application process. The corners of the container provide the dimensionally most stable and rigid area.

As shown, the rib structure 26 is provided generally adjacent the perimeter of the lid 16 and not in the center of the lid. The lid may carry relatively heavy loads and thus will deflect. Some of the deflection will be permanent and could be significant. If a deflected lid is stacked on a flat lid, the nest segments 28 would no longer engage the recesses 20. The positioning of the rib structure 26 helps to limit the deflections so the lid may stay functional.

Figure 8:
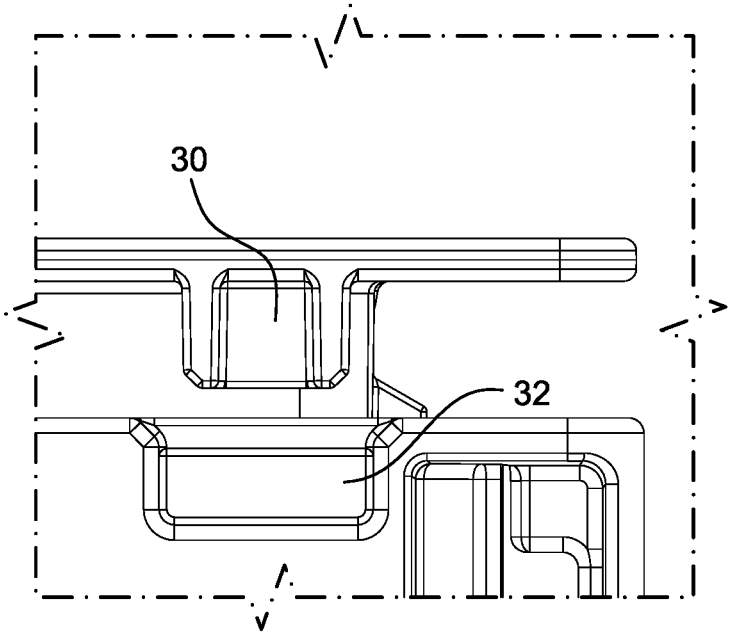
FIGS. 8 and 9 show operation of the engagement tabs.
Figure 9:
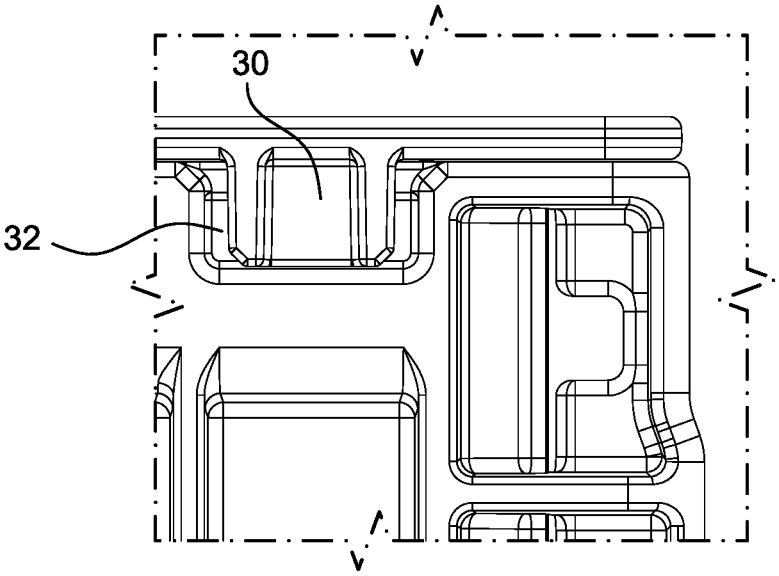

The bottom surface 24 of the container lid 16 may also be provided with one or a plurality of engagement tabs 30. In the embodiment shown in FIGS. 1-3, the container lid is provided with four engagement tabs 30 on the bottom surface 24. The container body 12 is provided with a corresponding plurality of engagement tab pockets 32 in the upper perimeter 14 (see FIGS. 1, 8 and 9). The engagement tabs 30 engage the engagement tab pockets 32 when the container lid 16 is secured on the container body 12. As discussed above, because the lid is without an outer perimeter skirt, under the load of packages or other containers stacked on the lid, the lid will tend to deflect downwards/inwards. The engagement tabs 30 prevent the container lid from sliding inward, which improves the load capacity of the container lid.

Figure 4:
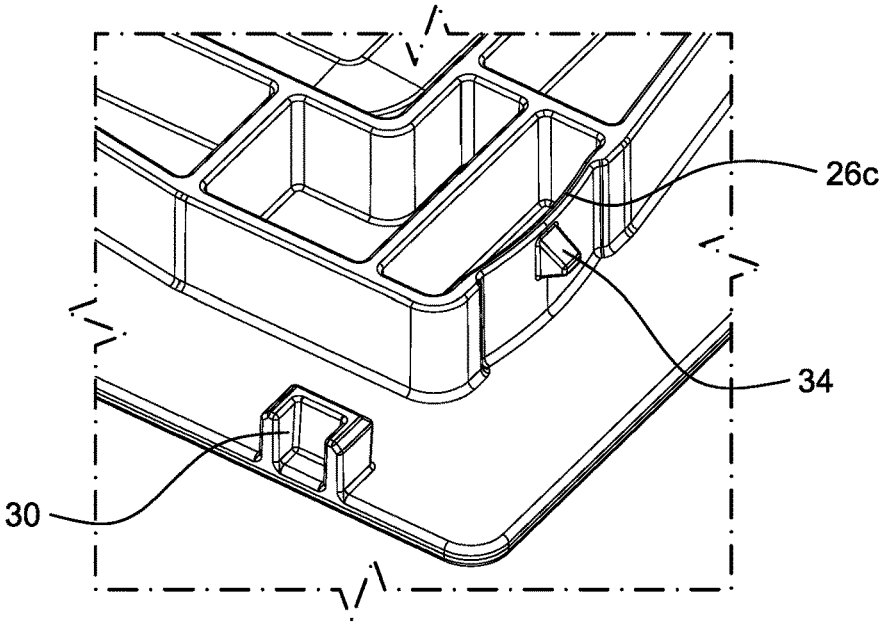
FIGS. 4 and 5 show details of the rib structure corner section.
Figure 5:
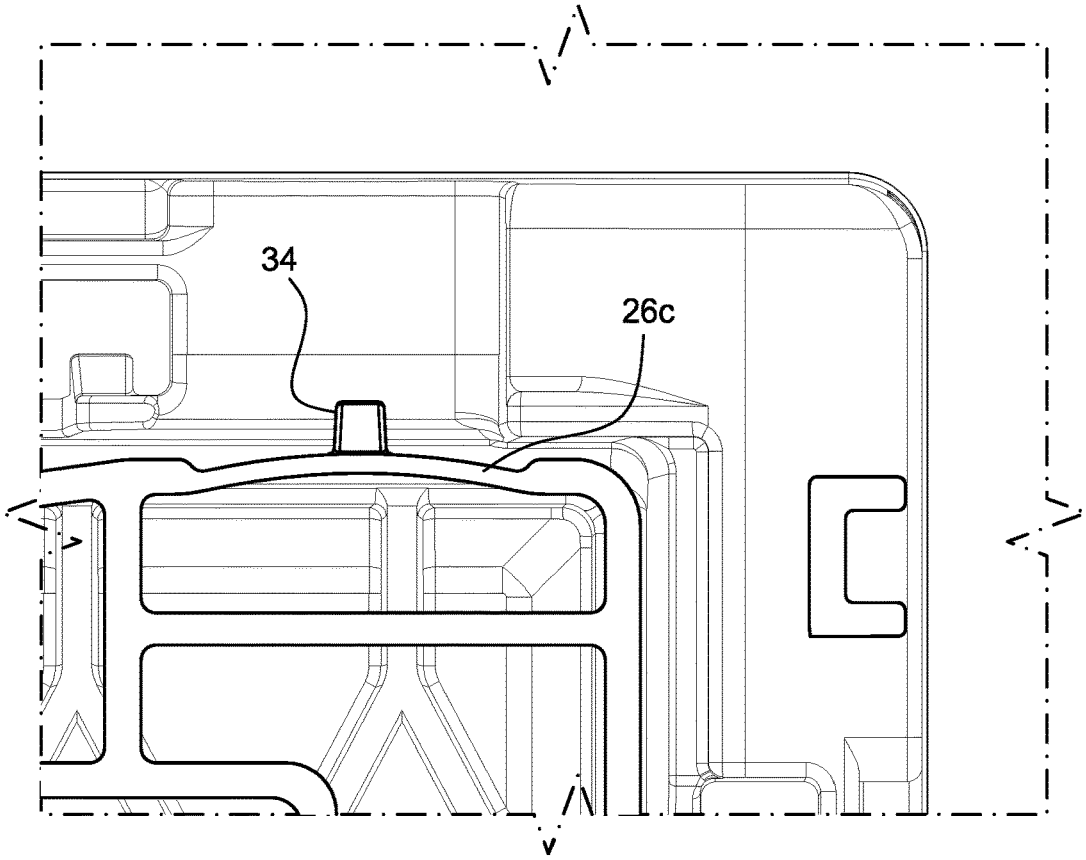
Figure 6:
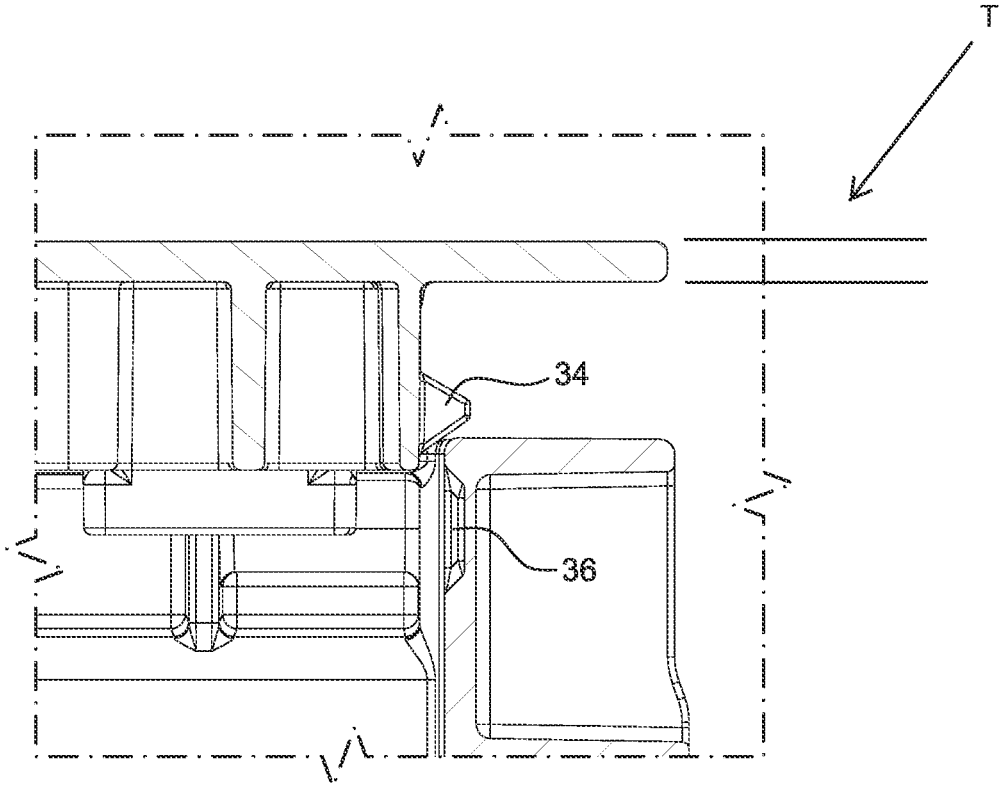
FIGS. 6 and 7 show operation of the snap segment.
Figure 7:
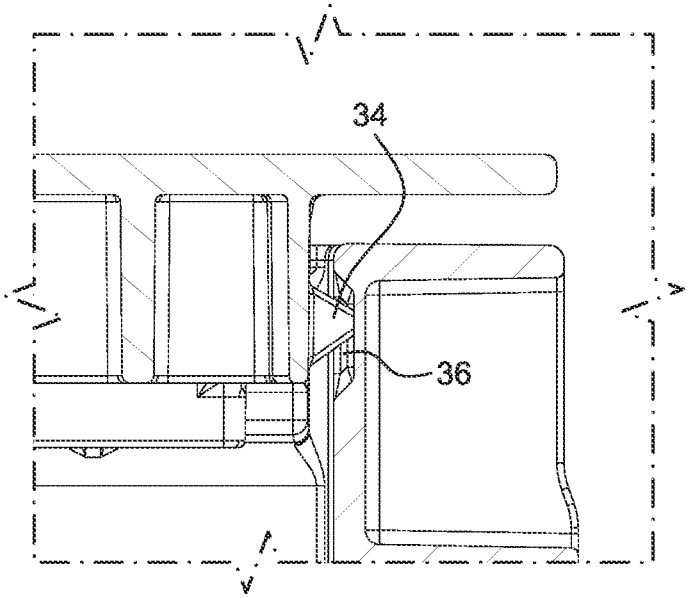

The container lid 16 may also include snap segments 34 on the rib structure 26. In some embodiments, the container lid 16 includes four snap segments 34. As shown in FIGS. 3-5, the snap segments 34 are positioned adjacent a corner of the rib structure. As shown in FIGS. 6 and 7, the container body may be provided with a corresponding plurality of snap segment recesses 36 in an inner wall of the upper perimeter 14. The snap segments 34 on the rib structure 26 engage the snap segment recesses 36 when the container lid is secured on the container body. In some embodiments, as shown most clearly in FIGS. 4 and 5, a component 26*c* of the rib structure 26 on which the snap segment 34 is disposed is thinner than a remainder of the rib structure 26. The thinner section facilitates deflection of the snap segments 34 into the snap segment recesses 36. The snap segments 34 secure the lid 16 on the container body 12. The pull-off force can be determined so it is still possible to remove the lid 16 from the plastic container with a reasonable force. The pull-off force is a function of the rib thickness, the necessary deformation, and the upper angle of the snap segment recess 36 and based on nominal dimensions. The container lid may need to be manufactured within a narrow tolerance window to maintain functionality of this aspect.

For storage and transport, container lids are typically column stacked, with a typical height limitation being the door height of a shipping trailer, which is about 106 inches. The container lid 16 of the described embodiments provides a very low nest height, and as a result, it is possible to stack up to 150 lids. At a lid weight of about two pounds per lid, the stack of lids would weigh up to 300 pounds. This is a significant top load onto the lid at the bottom layer. The nest segments 28 serve to transfer this weight through the stack onto the pallet on which the lids are stacked. To distribute the load as evenly as possible, the nest segments 28 are thus preferably spaced evenly around the lid.

The container lid without upward protrusions and without an outer perimeter skirt enables other unit loads to be stacked on a flat plane and facilitates handling by automation equipment. The recesses provide for secure nesting among a plurality of lids, which prevents the lids from sliding off a nested stack.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A stackable container lid comprising:

a top surface defining a flat surface plane, the top surface being without an upward protrusion, wherein the top surface extends across a majority of the container lid in the flat surface plane;

at least one recess in the top surface;

a bottom surface including a rib structure adjacent the perimeter of the lid; and at least one nest segment integrated with the rib structure and protruding from the rib structure, wherein the rib structure comprises corner sections at each corner thereof and support sections connected between the corner sections, wherein the corner sections are positioned closer to the perimeter than the support sections.

2. The stackable container lid according to claim 1, further comprising an engagement tab on the bottom surface.

3. The stackable container lid according to claim 2, comprising four engagement tabs on the bottom surface.

4. The stackable container lid according to claim 1, further comprising a snap segment on the rib structure.

5. The stackable container lid according to claim 4, wherein the snap segment is positioned adjacent a corner of the rib structure.

6. The stackable container lid according to claim 4, comprising four snap segments on the rib structure.

7. The stackable container lid according to claim 4, wherein the rib structure on which the snap segment is disposed is thinner than a remainder of the rib structure.

8. The stackable container lid according to claim 1, comprising a plurality of nest segments including two nest segments per each side of the container lid.

9. The stackable container lid according to claim 1, comprising a plurality of nest segments including one or two nest segments per each side of the container lid.

10. The stackable container lid according to claim 1, wherein a thickness of the container lid at the perimeter is consistent with a majority of non-perimeter portions of the container lid.

11. The stackable container lid according to claim 10, wherein the thickness of the container lid at the perimeter is consistent with the non-perimeter portions of the container lid except for the at least one recess.

12. The stackable container lid according to claim 10, wherein the container lid is without an outer perimeter skirt.

13. A container assembly comprising:

a container body including an upper perimeter; and a container lid securable on the upper perimeter of the container body and comprising:

a top surface defining a flat surface plane, the top surface being without an upward protrusion, wherein the top surface extends across a majority of the container lid in the flat surface plane, at least one recess in the top surface, a bottom surface including a rib structure adjacent the perimeter of the lid, and at least one nest segment integrated with the rib structure and protruding from the rib structure, wherein dimensions of an outer perimeter of the container lid do not exceed dimensions of the upper perimeter of the container body.

14. The container assembly according to claim 13, wherein the container body comprises a plurality of engagement tab pockets in the upper perimeter, and wherein the container lid comprises a plurality of engagement tabs on the bottom surface adjacent the perimeter, the engagement tabs engaging the engagement tab pockets when the container lid is secured on the container body.

15. The container assembly according to claim 13, wherein the container body comprises a plurality of snap segment recesses in an inner wall of the upper perimeter, and wherein the container lid comprises a plurality of snap segments on the rib structure, the snap segments engaging the snap segment recesses when the container lid is secured on the container body.

16. The container assembly according to claim 15, wherein the rib structure on which the snap segments are disposed is thinner than a remainder of the rib structure.

17. The container assembly according to claim 13, wherein the rib structure comprises corner sections at each corner thereof and support sections connected between the corner sections, wherein the corner sections are positioned closer to the perimeter of the bottom surface than the support sections such that only the corner sections register with the upper perimeter of the container body.

18. A stackable container lid comprising:

a top surface defining a flat surface plane without an upward protrusion, wherein at least a center of the top surface and an outer periphery of the top surface are in the flat surface plane;

at least one recess in the top surface;

a bottom surface including a rib structure adjacent a perimeter; and at least one nest segment integrated with the rib structure and protruding from the rib structure, wherein the container lid is without an outer perimeter skirt, wherein the rib structure comprises corner sections at each corner thereof and support sections connected between the corner sections, wherein the corner sections are positioned closer to the perimeter than the support sections.

* * * * *